US005201854A

United States Patent [19]

Ahl et al.

[11] Patent Number: 5,201,854

[45] Date of Patent: Apr. 13, 1993

[54] ELECTRICAL CONNECTOR FOR AN ELECTROPHOTOGRAPHIC PRINTING MACHINE

[75] Inventors: David K. Ahl, Rochester; Roger M. Swanson, Fairport; Timothy G. Struczewski, Rochester; James C. Fox, Ontario; Roy Lee, Webster; Michael Terietzki; Gary R. Skillman, both of Rochester; Ross E. Schroll, East Rochester, all of N.Y.

[73] Assignee: Xerox Corporation, Stamford, Conn.

[21] Appl. No.: 755,945

[22] Filed: Sep. 6, 1991

[51] Int. Cl.[5] ..... H01R 13/631

[52] U.S. Cl. ..... 439/247; 355/200

[58] Field of Search ..... 439/247, 248, 374, 377, 439/246, 249-252, 375, 376, 378-381; 355/200

[56] References Cited

U.S. PATENT DOCUMENTS 2,954,543 9/1960 Rayer et al. ..... 439/248

4,990,722 2/1991 Navazo ..... 174/97

5,035,627 7/1991 Burnett et al. ..... 439/377

FOREIGN PATENT DOCUMENTS 1455182 11/1976 United Kingdom ..... 439/248

*Primary Examiner*—Gary F. Paumen

*Attorney, Agent, or Firm*—Kenyon & Kenyon

[57] ABSTRACT

An apparatus for effecting electrical connection between the main machine and a module containing the apparatus for advancing a sheet through the transfer zone and to registration for information developed on the photoreceptor belt. The connector on the main machine is mounted to permit engagement with a complementary connector on the module, but provide for movement when the module is raised slightly to contact the photoreceptor module. The apparatus minimizes which otherwise would inhibit this upward movement and detract from proper operation of the machine and the quality of the copy produced.

11 Claims, 8 Drawing Sheets

ELECTRICAL CONNECTOR FOR AN ELECTROPHOTOGRAPHIC PRINTING MACHINE

BACKGROUND AND DISCUSSION OF THE INVENTION

This invention relates generally to an electrophotographic printing machine, and more particularly concerns a floating high voltage connector to enable movement of transfer module after electrical connection has been made.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementary colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

In connection with the invention, there is provided an apparatus for advancing a sheet through a transfer zone and into registration with information developed on a moving member. This apparatus is arranged in a module which can be removed from the main machine to remove the jammed sheets or for other maintenance. The module includes a corona generating device which sprays ions on the back side of the sheet so as to charge the sheet to the proper electrostatic voltage magnitude and plurality for attracting toner image from the photoconductive belt. An electrical connector is provided on the module for connecting the corona generating device to a power source in the main machine. A high voltage connector for this purpose is mounted in the rear of the main machine for connection and disconnection with the corresponding connector on the transfer module. When the drawer is opened to clear jammed paper, the electrical connection can be disconnected when the drawer is pulled out and away from the rear of the machine. For this purpose the machine connector and the module connector must register to ensure that electrical engagement between the operative part is obtained.

In the invention described herein, the position of the connector on the transfer module is such to permit connection for electrical engagement, but once in this position the module is raised slightly to contact the photoreceptor module. Thus, the connector in the main machine must be movable between a lower position where the connection is made and an upper position when the transfer module is raised to contact the photoreceptor module. This positioning is critical to copier quality and dependent upon the ability of the transfer module to move as described. Any forces which inhibit this movement detract from the proper operation of the machine and the ultimate quality of copy produced.

Other features of the present invention will become apparent as the following description proceeds and upon reference to the drawings.

DETAILED DESCRIPTION OF THE PREFERRED EMBODIMENT

Figure 1:
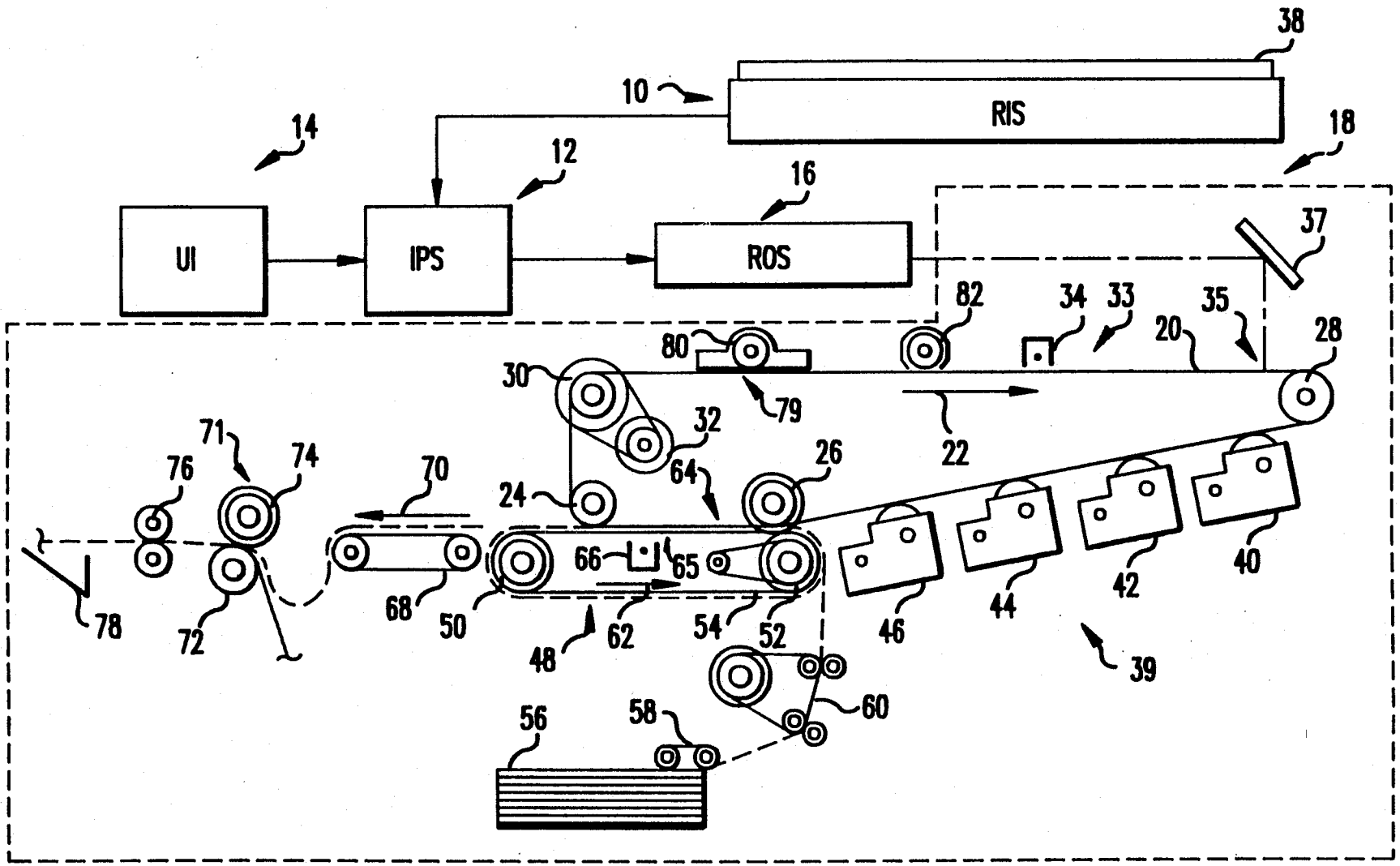
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charged coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

Figure 3:
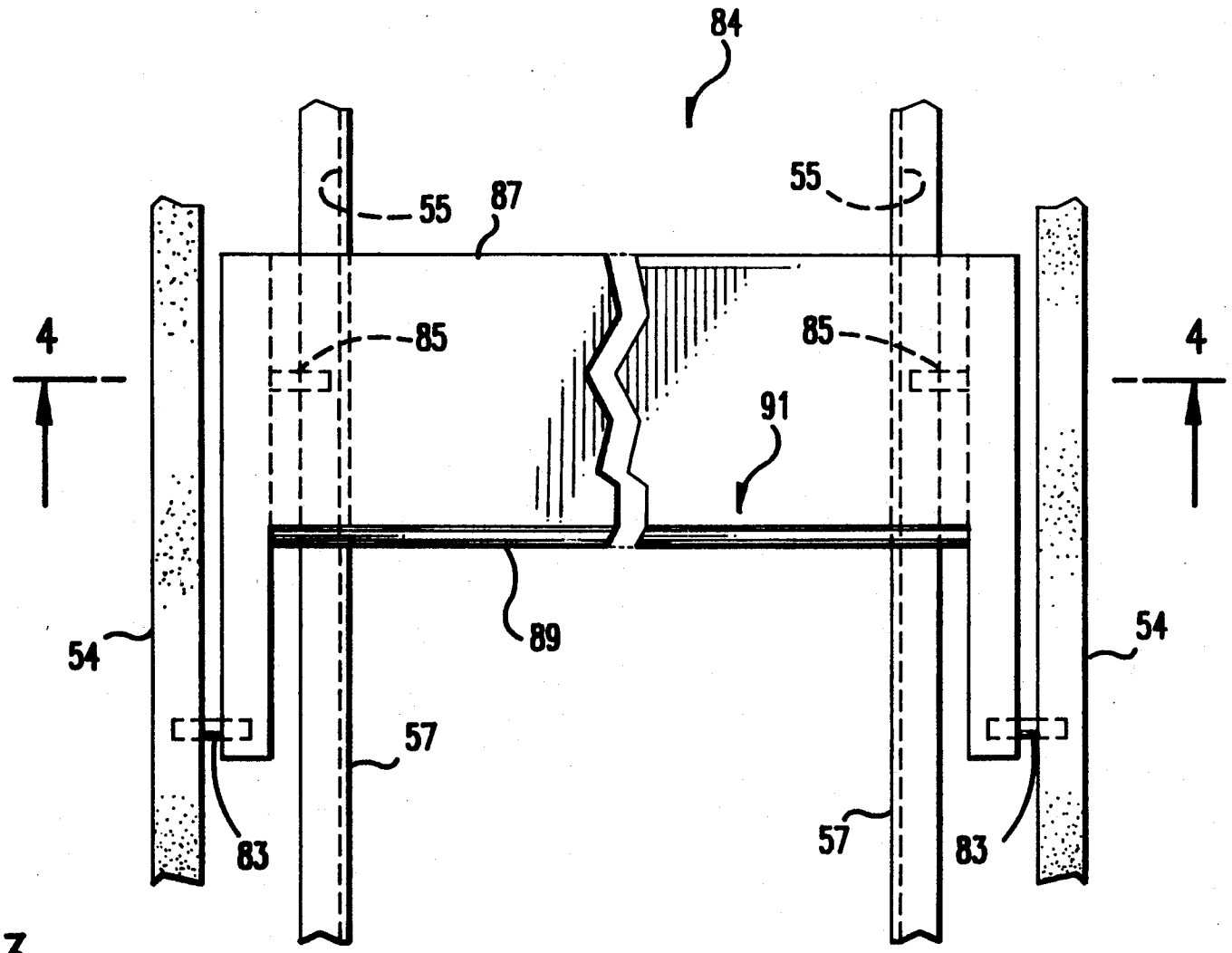
FIG. 3 is a schematic planar view showing the sheet gripper of the sheet transport system used in the electrophotographic printing machine of FIG. 1.
Figure 4:
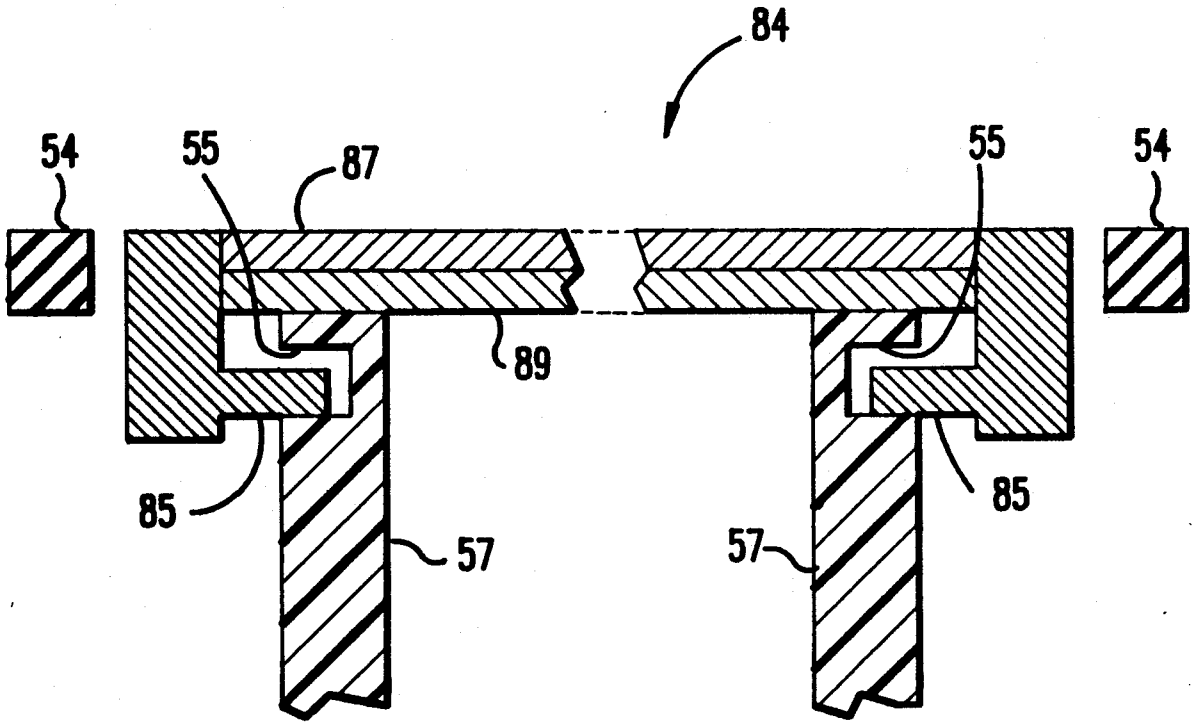
FIG. 4 is a sectional elevational view taken in the direction of arrows 4—4 in FIG. 3.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84, extends between belts 54 and moves in unison therewith. A sheet 25 is advanced from a stack of sheets 56 disposed on a tray. A friction retard feeder 58 advances the uppermost sheet from stack 56 onto a pretransfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e., a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport apparatus will be discussed hereinafter with reference to FIGS. 2–4. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to from the multi-color copy of the colored original document.

After the last transfer operation, the sheet gripper opens and release the sheet. A conveyor 68 transports the sheet, in the direction of arrow 70, to a fusing station, indicated generally by the reference numeral 71, when the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
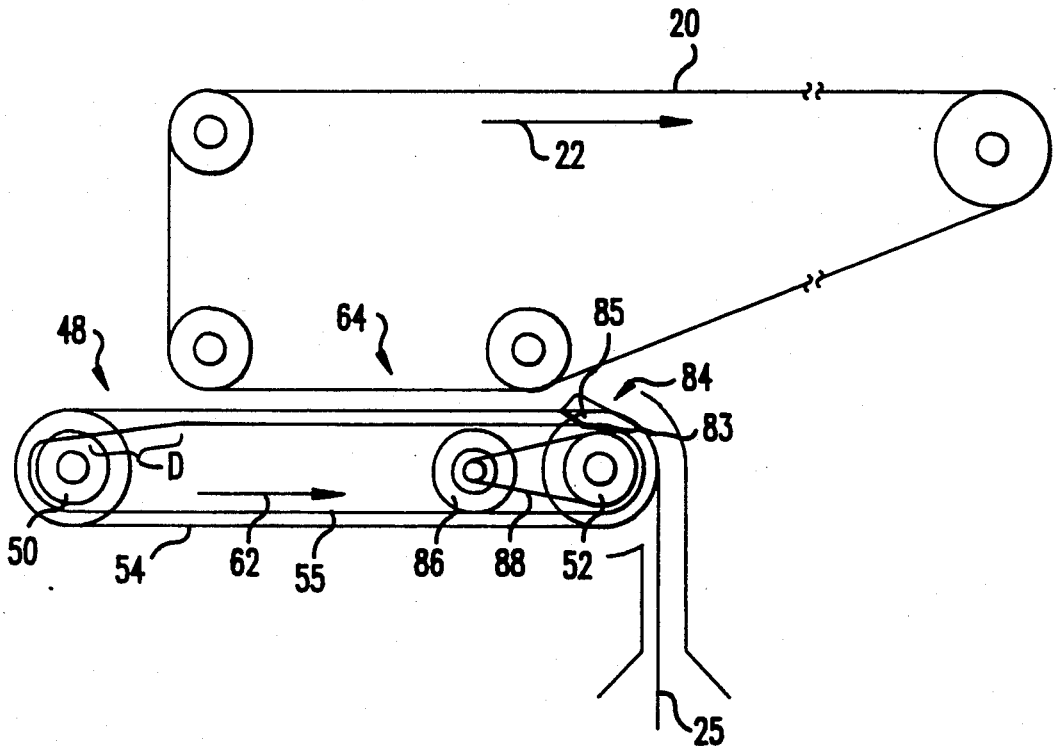
FIG. 2 is a schematic elevational view showing further details of the sheet transport system used in the electrophotographic printing machine of FIG. 1 and also showing the sheet gripper of the sheet transport system at a position prior to entering the transfer zone.

Referring now to FIG. 2, sheet gripper 84 is suspended between two spaced apart timing belts 54 mounted on rollers 50 and 52. Timing belts 54 define a continuous path of movement of sheet gripper 84. A servo motor 86 is coupled to roller 52 by a drive belt 88. Sheet gripper 84 includes a pair of guide members 85. A pair of spaced apart and continuous tracks 55 are respectively positioned substantially adjacent belts 54. Tracts 55 are respectively defined by a pair of track supports 56. Guide members 85 are slidably positioned within a respective track 55 (see FIGS. 3 and 4). Sheet gripper 84 further includes an upper sheet gripping portion 87 and a lower sheet gripping portion 89 which are spring biased toward each other. The sheet gripper includes a pair of cams (not shown) which function to open and close the gripping portions at predetermined intervals. In the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91. A silicone rubber coating (not shown) may be positioned upon lower sheet gripping portion 89, near gripping nip 91, in order to increase the frictional grip of sheet 25 between the gripping portions. Belts 54 are respectively connected to the opposed side marginal regions of sheet gripper 84 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected. In operation, belts 54 drive sheet gripper 84 at a constant velocity through transfer zone 64.

Figure 5:
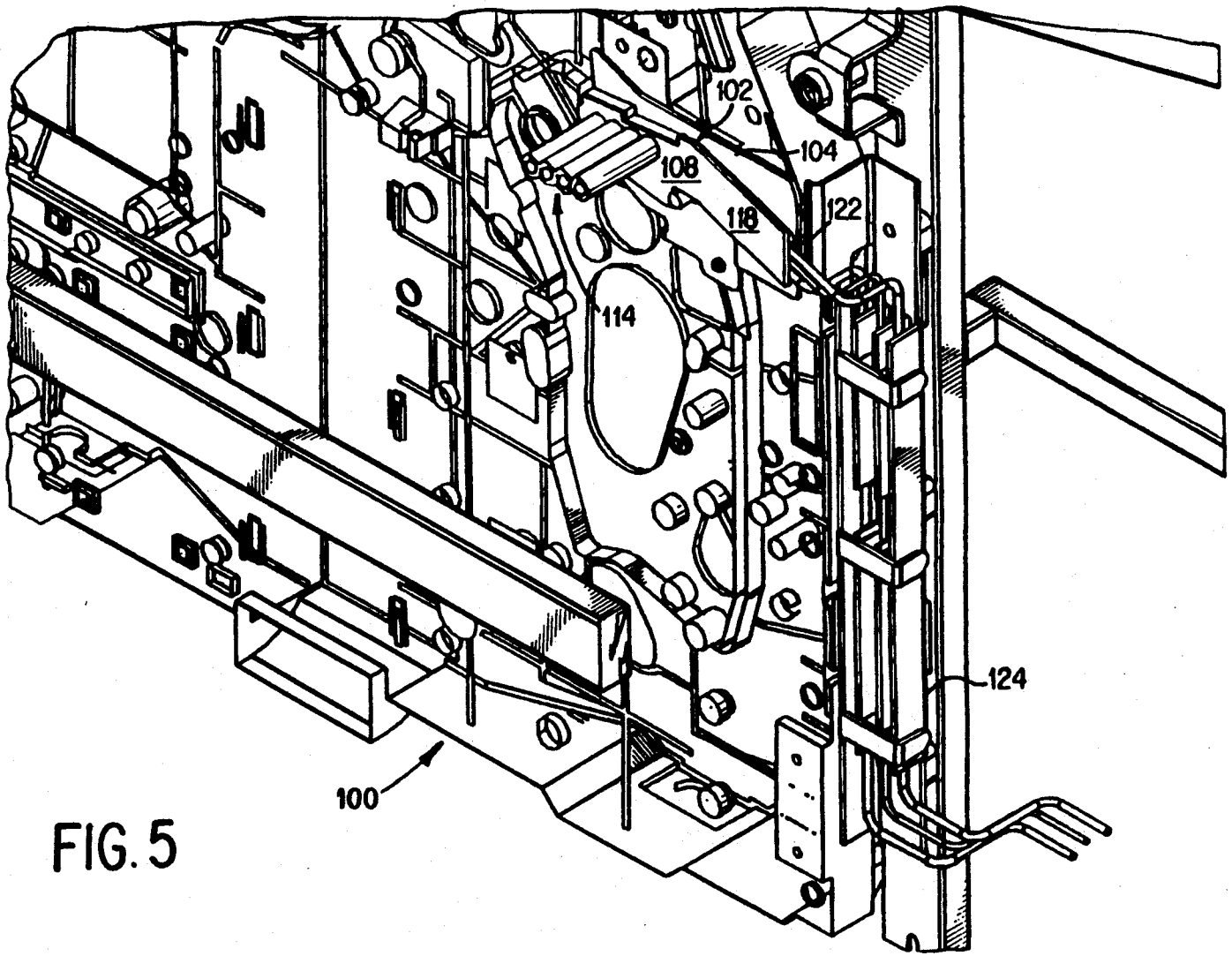
FIG. 5 is a perspective view of an internal portion of the main machine with the connector secured thereto.
Figure 7:
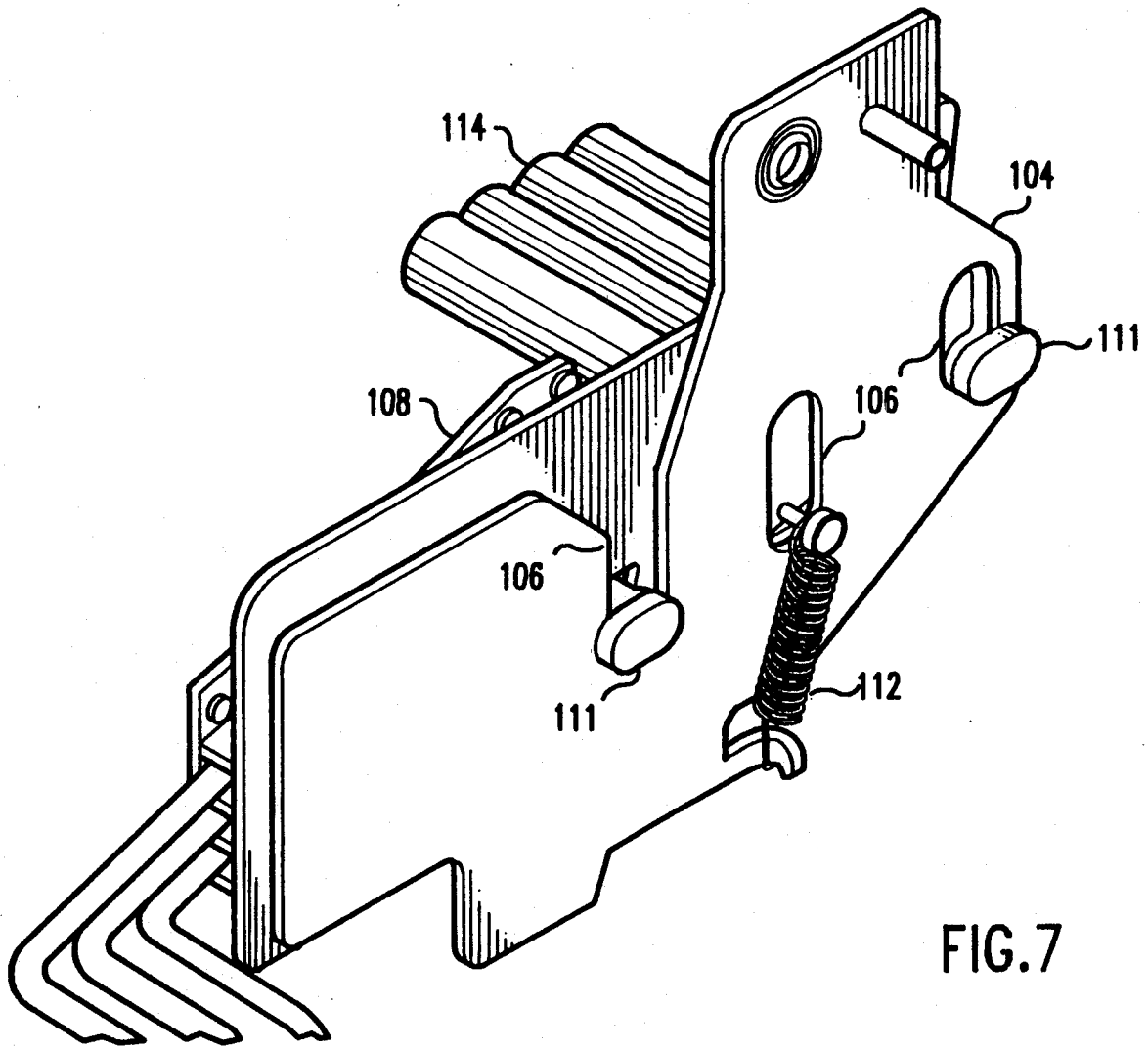
FIG. 7 is a rear view of the bracket assembly of FIGS. 5 and 6.

As can be seen in FIG. 5, the main machine casting 100 has fixed thereto a bracket assembly 102 having a fixed base portion 104, and a movable connector portion 108. The base portion 104 has three slots 106 therein for receiving a connector pin 110 and two locking pins 111 which permit movement in the vertical direction, but constrain movement in other directions (see FIG. 7). A spring 112 is arranged between the fixed portion and the connector pin 110 to bias the movable portion in a lower position. A connector receptacle 114 as shown having four receptacles for receiving a male plug portion extends from and is connected to movable portion 108. With this arrangement the movable portion is biased by spring 112 to a lower position for engagement by the male connector portion 116 on the transfer module 115 (see FIG. 8). Once the electrical connection is made between the connectors, the movable portion can be moved upwardly at least 6 mm with respect to the fixed based portion 104.

Figure 6:
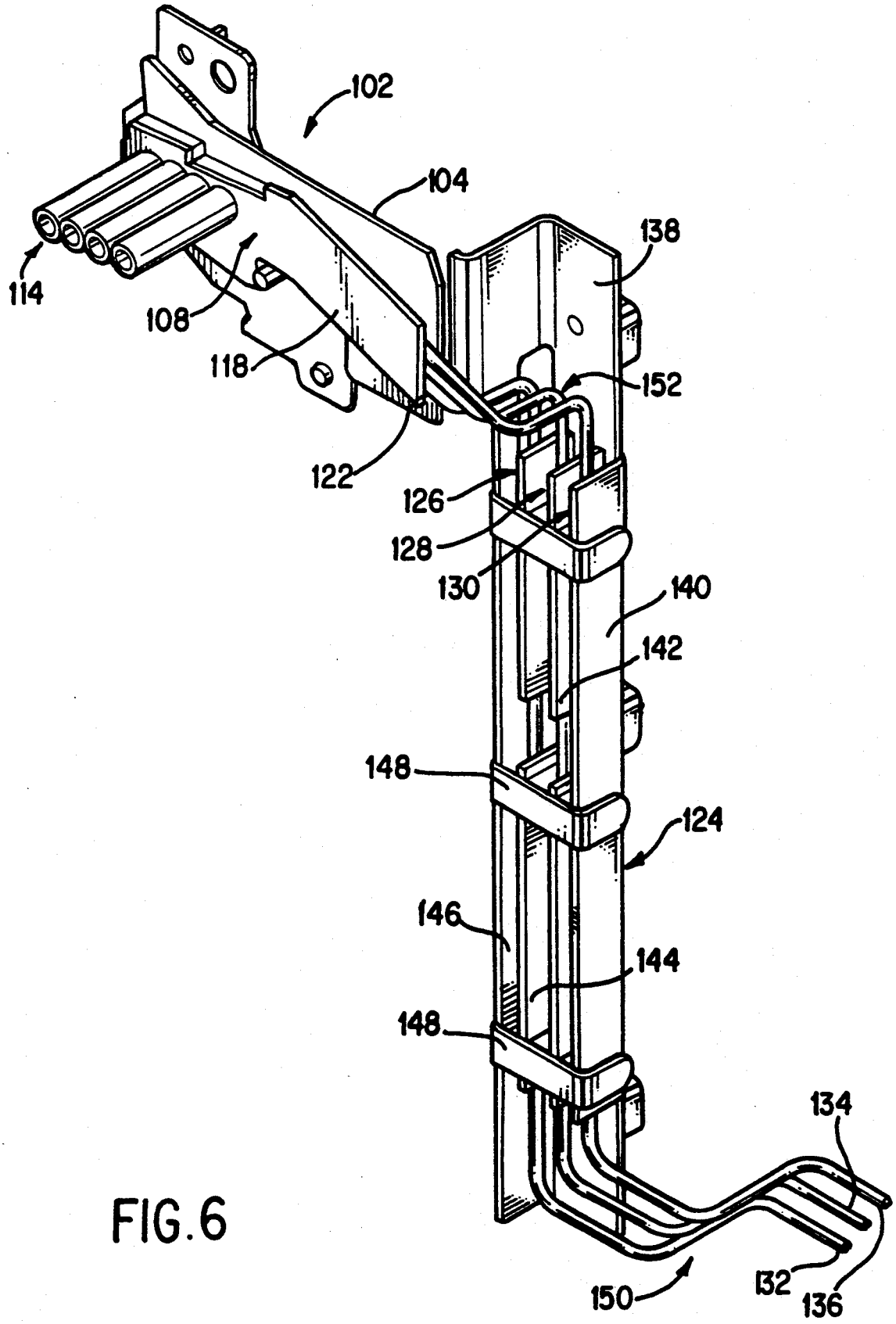
FIG. 6 is a perspective view of the bracket and wire loom assembly independent of the main machine.

As can be seen in FIG. 6, the rear portion of the connector has a terminal to which wires 132, 134, 136 as shown are connected. A channel bar 118 extends laterally from the movable portion to define a path for the wires 132, 134, 136. The channel bar defines at least three connector channels to house the three wires and move the wires with the movable connector portion as it moves from a lower to an upper position and vice versa.

Adjacent the bracket assembly, arranged in a fixed position with the main machine casting 100, is a wire loom 124 for carrying a portion of the wires 132, 134, 136, which are ultimately connected to a high voltage source. Each of these wires is arranged in its respective channel 126, 128, 130, in wire loom 124. The wire loom 124 includes rear wall 138 and vertical walls 140, 142, 144, and 146, that define the connector channels 126, 128 and 130 as shown. Spaced clips 148 are arranged along the length of the wire loom 124 to hold each of the wires in place within the channel as shown. With this arrangement the portion of the wires extending through the wire looms are in a relatively fixed relationship. These wires have a bracket end 152 extending between the upper end of the wire loom and the connector channels 122 of the movable bracket portion 108. Extending from the lower end of the wire loom is a source end 150 of the wires. Although the wires are fixed in the channel to avoid mingling or interaction with other elements of the machine, the bracket end of the wires and the source end of the wires are free to move. With respect to the bracket end, this permits movement of the connector after the transfer modules have been properly moved into a position adjacent the photoreceptor belt without adversely affecting this movement or other elements in the machine.

Figure 8:
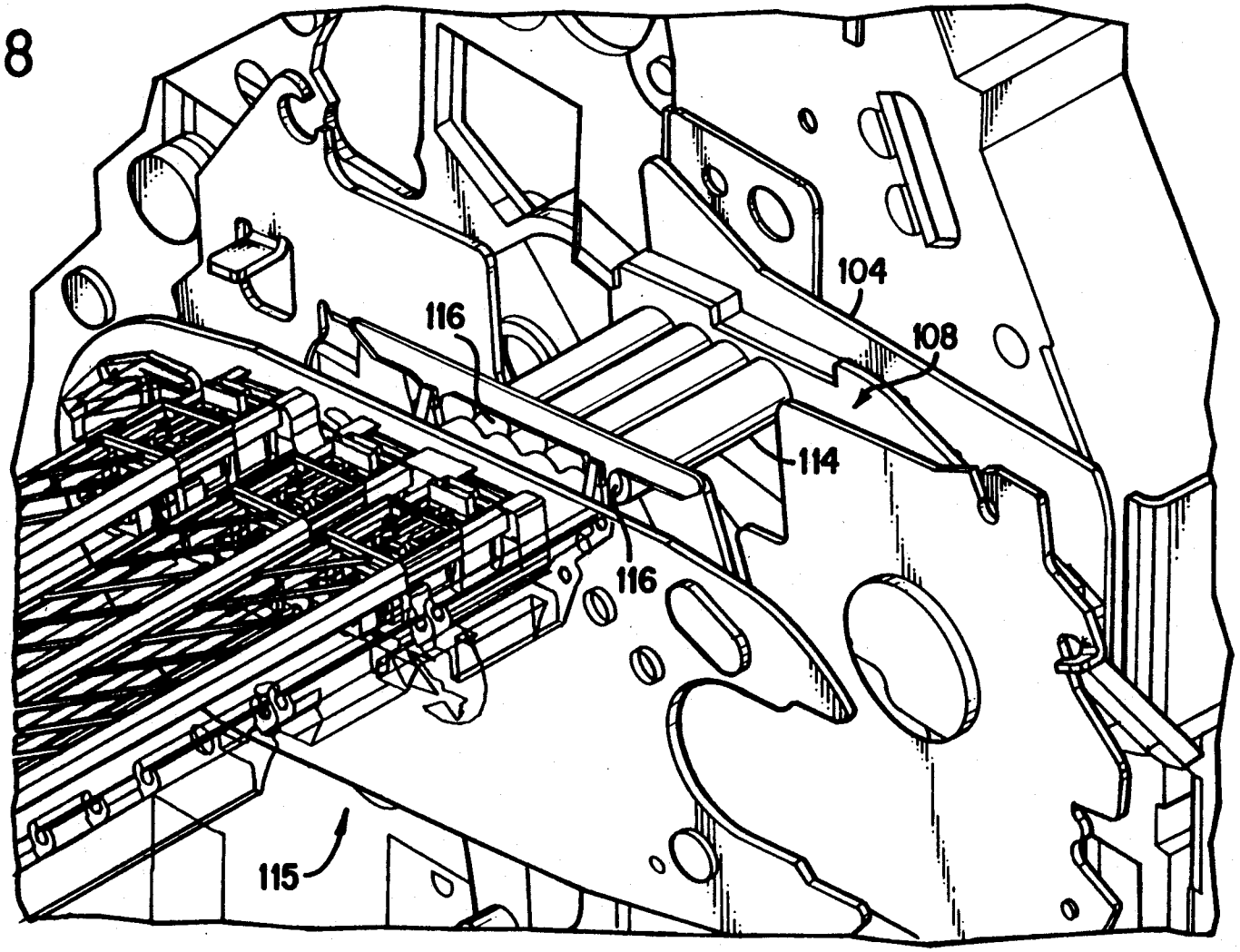
FIG. 8 is a perspective view of the bracket and wire loom assembly coupled between the main machine and a transfer module.

Referring to FIG. 8, the coupling of the main machine to the transfer module 115 is shown.

In operation the high voltage connector fixed bracket is mounted on the rear casting of the machine. The holes in the casting to accept the studs from this bracket are large enough to allow for tolerances in the transfer module mounting. On the assembly line, the connector is engaged with the transfer module and the down position and the nuts which retain the fixed bracket are tightened. This ensures correct location of the connector when the drawer is closed. Thus when the transfer module is pressed into its initial position, it engages the high voltage connector in the original installed position, then moved upward about 6 mm to ensure proper engagement between the transfer module and the photoreceptor belt. With this system, high voltage cables do not exert any significant forces on the connector as the wire channels avoid restraining vertical movement of the cable.

While the present invention has been described above in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

What is claimed is:

1. An apparatus for mounting an electrical connector in an electrophotographic printing machine comprising:

(a) a base bracket in theform of a plate being fixedly secured to said machine, said plate having a vertical slot therein;

(b) a movable plate having extending therefrom a pin for extending into the said slot and said movable plate being secured for movement relative to said base plate along a path defined by said slot;

(c) a transfer module comprising a sheet transfer assembly, said module having a first connector attached thereto;

(d) a second complementary connector for electrical engagement with said first connector;

(e) said second complementary connector being fixed to said movable plate;

(f) said movable plate being movable between a first position for engagement of said first and second connectors and a second position displaced vertically from said first position, a spring for biasing said movable plate towards said first position; and (g) a wire channel assembly fixed to said machine, wires extending from said second complementary member through said wire channel assembly with said wires being fixed to said wire assembly but a sufficient length of said wires being exposed between said wire channel assembly and said movable plate to permit vertical movement of said plate without restraining force being imposed by said wires.

2. An apparatus for mounting an electrical connector in an electrophotographic printing machine comprising:

(a) a base bracket being fixedly secured to said machine and including a vertical slot;

(b) a movable member including a pin extending through the slot of said base bracket, said movable member capable of vertical movement with respect to said base bracket;

(c) a module comprising a sheet transfer assembly, said module having a first connector attached thereto;

(d) a second complementary connector for electrical engagement with said first connector, said second connector being fixed to said movable member; and (e) said movable member being movable between a first position to allow engagement of said second connector with said first connector and a second position vertically displaced from said first position.

3. The apparatus according to claim 2 wherein said first position is vertically displaced beneath said second position.

4. The apparatus according to claim 3 further comprising bias means for biasing said movable member toward said first position.

5. The apparatus according to claim 4 wherein said bias means is a coil spring.

6. The apparatus according to claim 2 further comprising connector wires connecting said second connector to an electrical source and means for carrying said connector wires between said first position and said second position.

7. The apparatus according to claim 6 wherein said means for carrying said connector wires is a wire housing fixedly secured to said machine, said wire housing guiding said connector wires extending from said movable member.

8. The apparatus according to claim 3 further comprising connector wires, and a wire channel assembly fixed to said machine casting, said wires extending from said second connector through said wire channel assembly.

9. The apparatus according to claim 8 wherein said connector wires includes first, second and third wires extending through respectively first, second and third channels defined by said wire channel assembly.

10. The apparatus according to claim 9 further comprising means for holding said first, second and third wires in said first, second and third channels.

11. The apparatus according to claim 10 wherein said means for holding said wires includes retaining clips spaced along the length of said first, second and third channels.

* * * * *